US008163232B2

(12) United States Patent
Fang et al.

(10) Patent No.: US 8,163,232 B2
(45) Date of Patent: Apr. 24, 2012

(54) METHOD FOR MAKING FUNCTIONALLY GRADED CEMENTED TUNGSTEN CARBIDE WITH ENGINEERED HARD SURFACE

(75) Inventors: Zhigang Zak Fang, Salt Lake City, UT (US); Peng Fan, Salt Lake City, UT (US); Jun Guo, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 446 days.

(21) Appl. No.: 12/259,685

(22) Filed: Oct. 28, 2008

(65) Prior Publication Data

US 2010/0101368 A1 Apr. 29, 2010

(51) Int. Cl.
*B22F 3/24* (2006.01)
*B22F 3/12* (2006.01)

(52) U.S. Cl. ..... 419/29; 419/18; 419/38

(58) Field of Classification Search ..... 75/240; 419/18, 29, 38; 148/316
See application file for complete search history.

(56) References Cited

U.S. PATENT DOCUMENTS

| | | | | |
|---|---|---|---|---|
| 3,660,050 | A | 5/1972 | Iler et al. | |
| 4,610,931 | A | 9/1986 | Nemeth et al. | |
| 4,743,515 | A | 5/1988 | Fischer et al. | |
| 4,820,482 | A * | 4/1989 | Fischer et al. | 419/15 |
| 4,830,930 | A * | 5/1989 | Taniguchi et al. | 428/547 |
| 5,279,901 | A | 1/1994 | Akerman et al. | |
| 5,283,030 | A * | 2/1994 | Nakano et al. | 419/53 |
| 5,286,549 | A * | 2/1994 | Hartzell et al. | 428/212 |
| 5,401,461 | A | 3/1995 | Hartzell | |
| 5,413,869 | A | 5/1995 | Hartzell et al. | |
| 5,418,049 | A | 5/1995 | Drougge | |
| 5,453,241 | A | 9/1995 | Akerman et al. | |
| 5,541,006 | A | 7/1996 | Conley | |
| 5,549,980 | A | 8/1996 | Ostlund et al. | |
| RE35,538 | E * | 6/1997 | Åkesson et al. | 501/87 |
| 5,856,626 | A | 1/1999 | Fischer et al. | |
| 5,880,382 | A | 3/1999 | Fang et al. | |
| 6,063,502 | A | 5/2000 | Sue et al. | |
| 6,214,079 | B1 | 4/2001 | Kear et al. | |
| 6,638,474 | B2 | 10/2003 | Liu et al. | |
| 6,641,918 | B1 | 11/2003 | Sherman et al. | |
| 6,869,460 | B1 | 3/2005 | Bennett et al. | |
| 7,157,148 | B2 | 1/2007 | Takai et al. | |
| 2002/0194955 | A1 | 12/2002 | Fang et al. | |
| 2005/0126335 | A1 * | 6/2005 | Norgren et al. | 75/240 |
| 2005/0276717 | A1 | 12/2005 | Fang | |
| 2006/0040104 | A1 | 2/2006 | Wort et al. | |
| 2006/0266559 | A1 | 11/2006 | Keshavan et al. | |
| 2007/0214913 | A1 | 9/2007 | Fang | |
| 2008/0010905 | A1 | 1/2008 | Eyre | |

OTHER PUBLICATIONS

American Society for Testing and Materials ("Standard Test Method for Apparent Porosity in Cemented Carbides", Annual Book of ASTM Standards, 1996).

Miyamoto et al. ("Functionally Graded Materials: Design, Processing and Applications", Book, Kluwer Academic Publishers, 1999).

Put et al. ("Functionally Graded WC-Co Materials Produced by Electrophoretic Deposition", Scripta Materialia 45 (2001) 1139-1145).

Eso et al., University of Utah Department of Metallurgical Engineering; A New Method for Making Functionally Graded WC-Co Composites via Liquid Phase Sintering; paper presented at PM Tec2 conference in Chicago, Illinois, Jun. 2004.

Eso, Oladapo O., University of Utah Department of Metallurgical Engineering; Sintering Studies of Functionally Graded WC-Co Composites; handout distributed at PM Tec2 conference in Chicago, Illinois, Jun. 2004.

Eso et al., University of Utah Department of Metallurgical Engineering; Liquid Phase Sintering of Functionally Graded WC-Co Composites; to appear in Int. J. of Refractory Metals and Hard Materials, 2005.

Office Action of U.S. Appl. No. 11/152,716 dated May 1, 2009.

* cited by examiner

*Primary Examiner* — Roy King
*Assistant Examiner* — Ngoclan Mai
(74) *Attorney, Agent, or Firm* — Thrope North & Western LLP

(57) ABSTRACT

A method for manufacturing functionally graded cemented tungsten carbide with hard and wear-resistant surface and tough core is described. The said functionally graded cemented tungsten carbide (WC—Co) has a surface layer having a reduced amount of cobalt. Such a hard surface and tough core structure is an example of functionally graded materials in which mechanical properties are optimized by the unique combination of wear-resistance and toughness. WC—Co with reduced-cobalt surface layer may be fabricated through a carburization heat treatment process following conventional liquid phase sintering. The graded WC—Co thus obtained contains no brittle η phase.

10 Claims, 6 Drawing Sheets

METHOD FOR MAKING FUNCTIONALLY GRADED CEMENTED TUNGSTEN CARBIDE WITH ENGINEERED HARD SURFACE

BACKGROUND OF THE INVENTION

This application relates to functionally graded cemented tungsten carbide materials that contain a cobalt gradient. These materials may be abbreviated as WC—Co materials. Such materials may be used for metal cutting tools, rock drilling tools for oil exploration, mining, construction and road working tools and many other metal-working tools, metal-forming tools, metal-shaping tools, and other applications. For background information, the reader should consult U.S. Patent Application Publication No. 2005/0276717, which patent application is expressly incorporated herein by reference.

As explained in the prior patent publication noted above, it is desirable to construct a cemented tungsten carbide material ("WC" material) that includes an amount of cobalt. These materials are referred to as WC—Co materials. It is desirable to construct a WC—Co material that has a combination of toughness and wear-resistance.

Cemented tungsten carbide (WC—Co), consisting of large volume fractions of WC particles in a cobalt matrix, is one of the most widely used industrial tool materials for metal machining, metal forming, mining, oil and gas drilling and all other applications. Compared with conventional cemented WC—Co, functionally graded cemented tungsten carbide (FGM WC—Co) with a Co gradient spreading from the surface to the interior of a sintered piece offers a superior combination of mechanical properties. For example, FGM WC—Co with a lower Co content in the surface region demonstrates better wear-resistance performance, resulting from the combination of a harder surface and a tougher core. Though the potential advantages of FGM WC—Co are easily understood, manufacturing of FGM WC—Co is however a difficult challenge. Cemented WC—Co is typically sintered via liquid phase sintering (LPS) process in vacuum. Unfortunately, when WC—Co with an initial cobalt gradient is subjected to liquid phase sintering, migration of the liquid Co phase occurs and the gradient of Cobalt is easily eliminated.

BRIEF SUMMARY OF THE INVENTION

The present embodiments relate to a new method of forming a WC—Co composite that has a hard and wear resistant surface layer and tough core. A material with a hard surface and a tough core may be one in which the hardness of the surface is higher than that of the center of the interior by at least 30 Vickers hardness number using standard Vickers hardness testing method under 10 to 50 kilogram load. In a preferred embodiment, the hard wear resistant surface layer is comprised of the WC—Co with graded cobalt content. The cobalt content at the surface is significantly lower than that of the nominal composition of the bulk. The cobalt content increases as a function of the depth from the surface and can reach and even surpass the nominal composition of the composite at a certain depth. The interior of the composite beyond the surface layer, that is the bulk of the material, has a nominal cobalt composition. The method for making such a functionally graded composite involves heat-treating a pre-sintered WC—Co in a carbon rich atmosphere. The heat-treating can be accomplished by either as an added step to the standard sintering thermal cycle in the same sintering run, or a separate thermal cycle after the sintering is completed. The heat treatment must be carried out within a temperature range in which the tungsten carbide WC coexists with liquid as well as solid cobalt. The base WC—Co composite has a nominal carbon content that is sub-stoichiometric before heat treatment. The carbon content of the base WC—Co composite is high enough such that there is no η-phase in the composite at any temperature at any time during the sintering and heat treatment process, or after sintering and heat-treatment.

The present embodiments include a method of preparing a functionally graded cemented tungsten carbide material, the method comprising preparing a WC—Co powder, compacting the powder, sintering the powder, and heat treating the sintered body within a specified temperature range in a furnace having a carburizing atmosphere, wherein the material, after the heat treating step, comprises a surface layer with lower Co content than that of the nominal value of the bulk of the material. The WC—Co powder before sintering has sub-stoichiometric carbon content. In other embodiments, the WC—Co powder has sub-stoichiometric carbon content that is higher than the carbon content that would result in the formation of η-phase in the material at any temperature at any time during or after sintering and/or heat treatment. In further embodiments, the atmosphere is a carburizing gas mixture, preferably formed by a methane-hydrogen mixture with the partial pressure ratio of $(P_{H2})^2/P_{CH4}$ ranging from 1000 to 10, preferably within the range of 600 to 100. Other embodiments may be designed in which the sintering and heat treating are conducted in one furnace run without removing the material from the furnace after the sintering step. The heat treatment step may be performed at a temperature of 1300° C. In other embodiments, the heat treatment step may occur between 1260 and 1330° C. Additional embodiments are designed in which the temperature range for carburizing heat treatment is the range in which solid tungsten carbide WC, liquid cobalt, and solid cobalt coexist. Yet further embodiments are designed in which the sintering and heat treating are conducted in two separate furnaces, i.e. two separate thermal cycles.

Additional embodiments are designed in which the functionally graded WC—Co comprises a harder surface layer and tougher core. In some embodiments, the cobalt content of the surface layer has is less than 90% of the bulk interior or the nominal average value of the composite. Other embodiments are designed in which the cobalt content of the composite increases as a function of the depth from the surface until it reaches or surpasses the nominal average cobalt content of the composite. The surface layer may have a thickness greater than 10 micrometers. Other embodiments may have the surface layer have a thickness less than 10% of the over thickness or relevant dimension of the component. Further embodiments are designed in which the WC—Co powder contains one or combinations of the following elements and/or of their carbides: titanium, tantalum, chromium, molybdenum, niobium, and vanadium.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
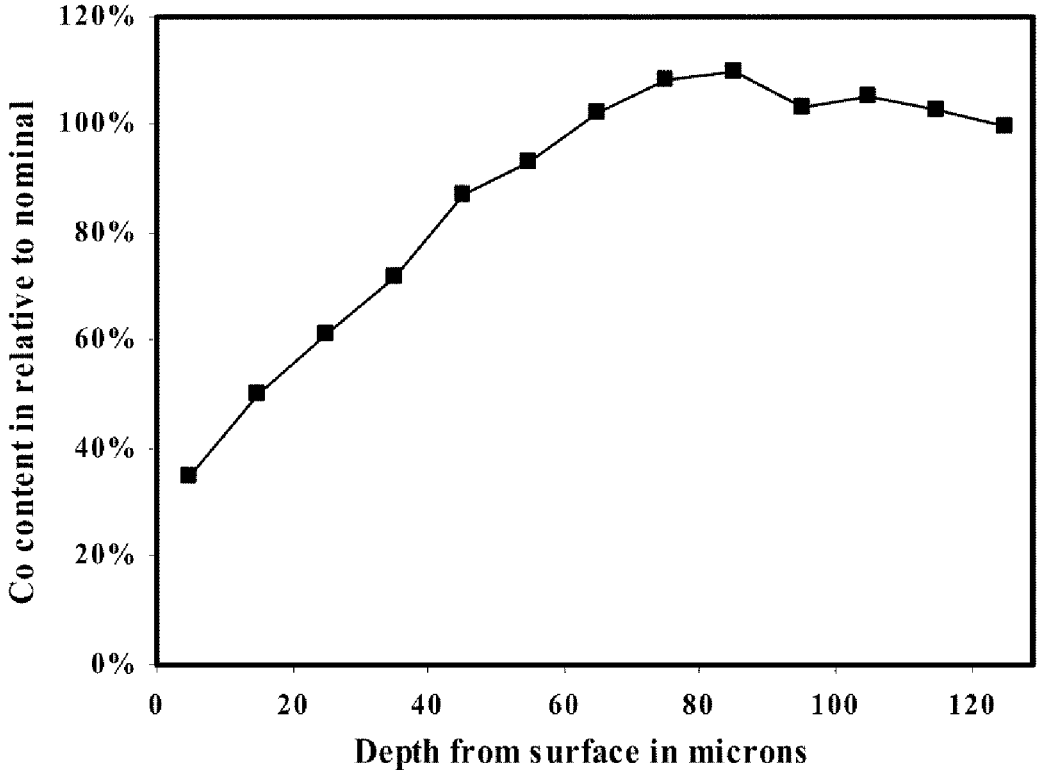
FIG. 1 is a graph showing cobalt content in the surface region of a WC—Co sample, indicating the formation of surface layer with reduced cobalt content, the material being formed at 1300° C., for 60 minutes with an atmosphere $(P_{H2})^2/P_{CH4}=200$.

The presently preferred embodiments of the present invention will be best understood by reference to the Figures, wherein like parts are designated by like numerals throughout. It will be readily understood that the components, steps, etc. of the present invention, as generally described herein and illustrated in any applicable drawings, could be arranged and designed in a wide variety of different configurations. Thus, the following more detailed description of the embodiments of the present invention, as represented in Figures is not intended to limit the scope of the invention, as claimed, but is merely representative of presently preferred embodiments of the invention.

The present embodiments involve constructing WC—Co materials using liquid phase sintering, which are prepared according to standard methods, and an uniquely designed heat treatment process. Such methods include preparing a WC—Co powder (which includes a mixture of WC, W, C, and cobalt powders), compacting the powders together. In some embodiments, the powders will be compacted using known techniques, such as using uniaxial cold dies pressing methods. After compaction, the powder may then be sintered according to standard sintering procedures, such as at 1400° C. under a vacuum. As is known in the art, such sintering processes produce a homogeneous WC—Co material, with the amount of Co in the WC matrix being equal (homogenous or substantially homogenous) throughout the entire sample.

In the present embodiments, however, an additional step must be performed to produce desired functionally graded (FGM) WC—Co composite. This step is a "heat treatment" step. This heat treatment step is conducted either in the same sintering furnace run without removing the sample from the furnace, or in another furnace in a separate thermal cycle, i.e. heat treatment run. The desired FGM WC—Co has a high hardness and wear-resistant surface layer and a tough core.

In a preferred embodiment, the hard wear resistant surface layer is comprised of the WC—Co with graded cobalt content. The cobalt content at the surface is significantly lower than that of the nominal composition of the bulk. Nominal composition is the average composition of the material regardless whether it is homogeneous or graded. The cobalt content increases as a function of the depth from the surface and can reach and even surpass the nominal composition of the composite at a certain depth. The interior of the composite beyond the surface layer, that is the bulk of the material, has a nominal cobalt composition. The cobalt content at the surface is less than 90% of the nominal composition. The depth of the surface layer, defined as the thickness from the surface to the depth at which the cobalt composition gradually rises up to equal that of the bulk interior, i.e. the nominal composition, must be great than 10 microns.

To manufacture the said preferred product, the following method is described.

WC—Co powder mixtures are prepared according to standard manufacturing procedures as used in the industry.

The WC—Co powder must have a carbon content that is sub-stoichiometric, or carbon deficient relative to stoichiometry as it is known in the industry. Stoichiometric carbon content of WC by its formula is 6.125% by weight. After cobalt is added, total carbon content will decrease proportionally depending on the cobalt content. The stoichiometric carbon content of a WC—Co composite, designated as $C_{s\text{-}comp}$, can be expressed as $C_{s\text{-}comp}=6.125\times(1\text{-wt \% Co}/100)$. For example, if the cobalt content of a WC—Co is 10 wt %, then the total stoichiometric carbon content of the composite is 5.513 wt %. According to this invention, the carbon content of the starting powder mixture of WC—Co must be smaller than $C_{s\text{-}comp}$.

Another aspect of the invention regarding the carbon content of the starting material is that it must be high enough such that there is no η-phase in the composite at any temperature at any time during the sintering and heat treatment process, or after sintering and heat-treatment. η-phase is an undesired brittle complex carbide of W and Co with a typical formula of $Co_3W_3C$, that forms when the total carbon content is excessively low. The minimum carbon content in sintered WC—Co with no η-phase, designated as $C_\eta$, will decrease with increasing cobalt content. For example, if the cobalt content of a WC—Co is 10 wt %, then the minimum total carbon content of the composite is 5.390 wt %. Therefore, for a WC—Co with 10 wt % Co, the total carbon content of the starting WC—Co powder mixture should be within the range of 5.390 to 5.513 wt %. In other words, according to this invention, the total carbon content of the starting WC—Co powder mixture should be greater than $C_\eta$ and smaller than $C_{s\text{-}comp}$.

Another aspect of the invention is that the heat treatment must be carried out within a temperature range in which the solid tungsten carbide (WC) phase coexists with liquid as well as solid cobalt phase, i.e. a three phase coexisting range. This is an important factor to insure that significant cobalt gradient can be obtained. Typically the temperature for heat treatment is between 1250 to 1330° C. When carbides of other transitional elements such as V, Cr, Ta, Ti, and Mo, are added, the temperature will trend lower because the temperature range for the three phase region will be lower.

Another aspect of the invention is that the heat treatment must be carried out in a carburizing atmosphere, which may be chosen from a large variety of gases and gas mixtures at a pressure ranging from higher than 1 atm to lower than 10 torr. If the mixture of methane and hydrogen is used, the value of $(P_{H2})^2/P_{CH4}$, which is inversely proportional to the carburizing ability of this gas mixture, needs to be not larger than 1000.

Yet another aspect of the invention is that the heat treatment process can be carried out as an added step to the standard sintering cycle without removing the specimens from the furnace. In other words, the desired FGM WC—Co material can be produced in one thermal cycle from powder. This is possible because of the kinetic rate of the cobalt gradient formation is sufficiently fast. A separate treatment procedure may also be used if so desired due to other non-technical reasons.

The principles of the present invention are further elaborated as follows.

Figure 2:
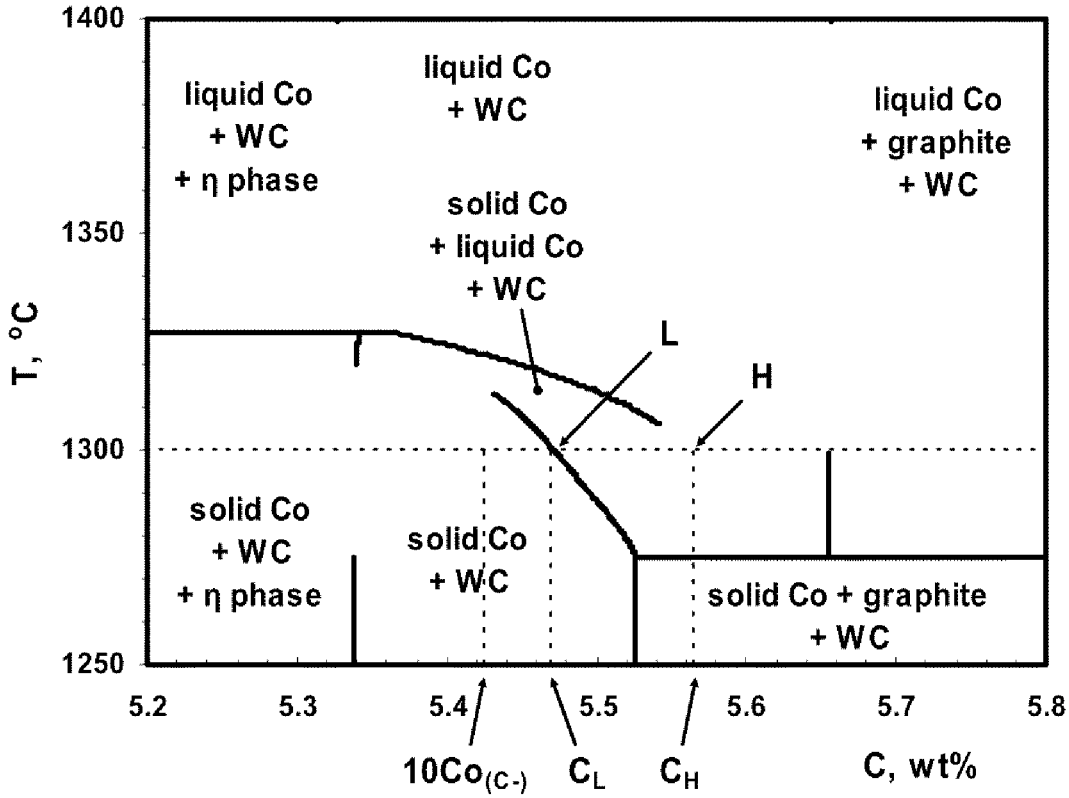
FIG. 2 is a vertical section of a ternary phase diagram of W—Co—C system with 10 wt % Co.

FIG. 2 is a vertical section of a ternary phase diagram of W—Co—C system with 10 wt % Co. As indicated on the Figure, there is an area that is a three phase region in which WC, liquid cobalt, and solid cobalt co-exist. For a given temperature within the three-phase equilibrium range, the volume fraction of the liquid is a function of the carbon content. For example, at 1300° C., the volume fraction of liquid phase at point H is 100%; whereas at point L, the volume fraction of the liquid approaches zero. Thus, if there is a carbon content gradient in a WC—Co material that traverses the range from point L to H, there will also be a gradient of the volume fraction of the liquid, which would give rise to the migration of the liquid cobalt phase. In this study, the carbon gradient is established by heat treating a fully sintered WC—Co specimen in a carburizing atmosphere. The WC—Co material should have an initial carbon content that is less than $C_H$, and preferably less than $C_L$, as shown in FIG. 2. During the carburizing heat treatment, a small increase in carbon content near the surface will lead to a carbon gradient between the surface and the interior and a significant increase of liquid Co volume fraction near the surface. The increase of liquid Co in the surface region breaks the balance of liquid Co distribution and induces the migration of Co from the surface region with more liquid Co towards the core region with less liquid Co. Therefore, a continuous Co gradient with lower Co content near the surface is created with the carburizing heat treatment.

EXAMPLES

In many embodiments, WC—Co powders with 10% Co by weight were used as examples. It should be noted that this invention and the principles outlined herein apply to other WC—Co materials with differing nominal percentages of cobalt. For example, the same gradient and procedures may be used for WC—Co materials having a nominal cobalt percentage ranging from 6 to 25%. It should also be understood that Co can be substituted in part or in whole by other transition metals such as nickel (Ni) and/or (Fe).

The composition of WC—Co used for demonstration is listed in Table 1, where $10Co_{(C-)}$ indicates that the total Co content is 10 wt % and the total C content is sub-stoichiometric. Tungsten powder was added to commercial WC powder and cobalt powder to reduce the total carbon content. The powder mixtures were ball milled in heptane for four hours in an attritor mill. The milled powders were dried in a Rotovap at 80° C. and then cold-pressed at 200 MPa into green compacts of 2×0.5×0.7 $cm^3$ in dimension. The green compacts were sintered in vacuum at 1400° C. for one hour.

Carburizing heat treatments of sintered samples were conducted in atmospheres of mixed methane ($CH_4$) and hydrogen ($H_2$). The heat treatments were conducted at three temperatures—1400° C., 1300° C. and 1250° C. As pointed out earlier, 1300° C. is selected because the carburization conducted in a three-phase region is expected to create desired Co gradient, while the other two temperatures (1400° C. and 1250° C.) outside the three-phase region are chosen for comparison. 1400° C. is the typical liquid sintering temperature in the WC—Co(1) two phase region, while at 1250° C., the system is completely at solid state. The effect of time is investigated by holding at 1300° C. for 15 minutes to 180 minutes. To study the effect of carburizing atmosphere, gas mixtures of varied $H_2$-to-$CH_4$ ratios with $(P_{H2})^2/P_{CH4}$ in the range of 150 to 300 were used.

The treated samples would be compared with un-treated samples to examine the effect of atmosphere. To analyze the samples, the cross-sections of specimens were polished and etched with Murakami's reagent for 10 seconds to determine if there was any $Co_3W_3C$ (η phase) present. Cobalt concentration profiles perpendicular to the surface were measured using the Energy Dispersive Spectroscopy (EDS) technique. Each data point of the cobalt content is an averaged value obtained by scanning a 10 μm by 140 μm rectangular area on the polished surface. The standard variation of the data is less than 10% of the measured cobalt content.

TABLE 1

Compositions of WC—Co used for this study

| Sample | Initial total Co content, wt % | Initial total C content, wt % |
|---|---|---|
| $10Co_{(C-)}$ | 10.0 | 5.425 |

Note:
stoichiometric C content is 5.513 wt % for WC-10 wt % Co.

Effects of Temperature on the Formation of Co Gradient

Figure 3:
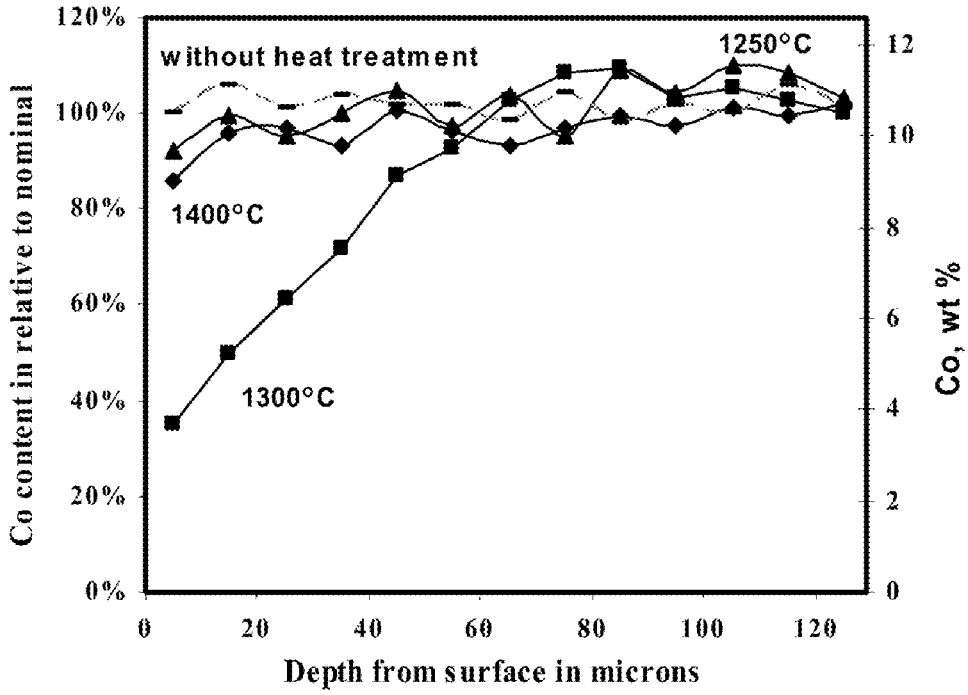
FIG. 3 shows the cobalt distribution profile of sintered $10Co_{(C-)}$ specimen before and after atmosphere treatment at temperatures of 1400° C., 1300° C. and 1250° C. with gas ratio of $(P_{H2})^2/P_{CH4}=200$ for 60 min.

As described herein, sintered specimens were heat treated at three temperatures 1400° C., 1300° C. and 1250° C. FIG. 3 shows the effect of temperature at a fixed atmosphere with $(P_{H2})^2/P_{CH4}=200$. Holding time at the treatment temperature was 60 minutes.

As shown in FIG. 3, for the specimen treated at 1300° C., there is a continuous Co gradient as a function of the depth, while the Co content profile of the specimen without treatment is flat. It is shown that within a depth of approximately 80 μm the Co content increases from 4% to 12%. Deeper into the specimen, the Co content gradually reaches nominal Co % in the interior portion of the specimen.

Figure 4:
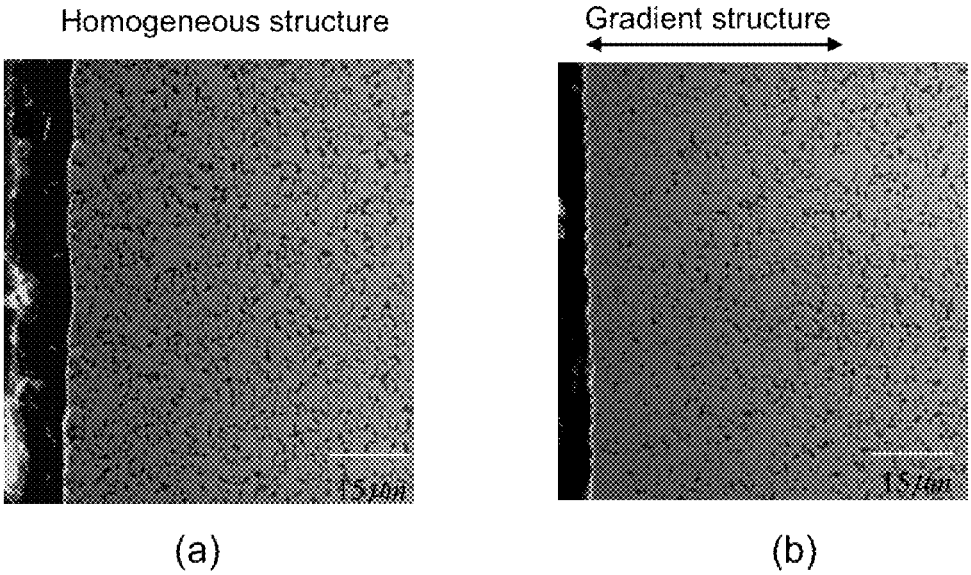
FIG. 4 is a SEM micrograph of cross sections of the bulk samples of $10Co_{(C-)}$ (a) before atmosphere treatment; (b) treated at 1300° C. by atmosphere: $(P_{H2})^2/P_{CH4}=200$ for 60 min., wherein the surface is to the left of the image.

Before heat treatment, the microstructure of the sintered sample (FIG. 4*a*) was uniform and there was neither free carbon nor η-phase. After the heat treatment at 1300° C., a gradient structure (FIG. 4*b*) was developed from the surface inward. This is demonstrated by the microstructure in the surface region than that of inner part, suggesting lower cobalt content in the surface region. Free carbon was not observed, indicating the carburization process was not excessive.

However, as shown in FIG. 3, the formation of Co gradient is not seen in the specimens treated at 1400° C. and 1250° C. When the specimen was treated 1400° C. (the liquid phase sintering temperature) in the same atmosphere as those treated at 1300° C., significant amount of free carbon was formed near the surface while no gradient of Co was observed. Furthermore, when the specimen was treated at 1250° C. in the same atmosphere, the microstructure showed little change from its initial condition. There was neither a Co gradient nor a free carbon phase.

This result indicates that the Co-gradient structure without formation of free graphite or η phase is developed by a carburizing heat treatment at the temperature at which liquid-Co and solid-Co coexists. A temperature of 1300° C. is thus selected for demonstrating the effects of other factors on the formation of a Co-gradient.

Effect of Gas Ratio of Atmosphere on the Formation of Co Gradient

Because the liquid phase migration is induced by the gradient of carbon content from the surface to the interior of the specimens, the chemical potential of carbon in the atmosphere with respect to that of the specimen is logically an important factor. To study the effects of carbon potentials, the heat treating atmospheres are controlled by varying $H_2/CH_4$ ratios with $(P_{H2})^2/P_{CH4}$ ranging from 300 to 150. The sintered specimen was heat treated at 1300° C. for 60 minutes.

Figure 5:
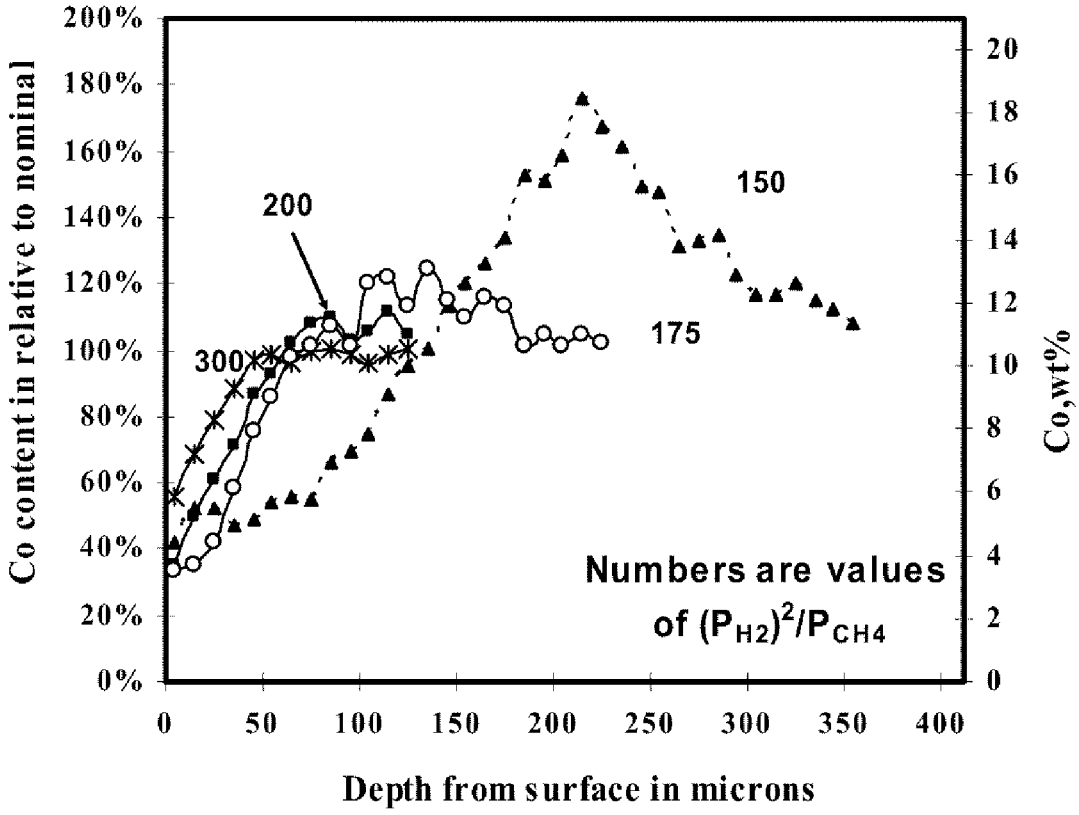
FIG. 5 shows the cobalt distribution profile of $10Co_{(C-)}$ specimen which was heat treated by atmospheres with varied $H_2/CH_4$ ratios and holding at 1300° C. for 60 min.

FIG. 5 shows the Co gradients developed under varied atmosphere conditions exhibiting a similar trend but with differences in the depth and amplitude of the cobalt gradient. It should be noted that there was no free graphite phase found in any of the treated specimens as a result of the carburizing atmosphere. The amplitude of Co gradient is defined as the difference between the highest Co content and the lowest Co content in each continuous Co concentration profile. With increasing volume fraction of $CH_4$ in the mixed gas, the gradient of Co is formed in greater depth from the surface and also with larger amplitude. For specimens that were treated using atmosphere with $(P_{H2})^2/P_{CH4}$ of 300 or 200, the Co content increases steadily from the surface with the depth into the core of the specimen until the cobalt content approaches the nominal value. While for the specimens that were treated using $(P_{H2})^2/P_{CH4}$ of 175 and 150, the Co content increases gradually from the lowest Co content at the surface to a peak value that is significantly higher than the nominal value of the bulk as noted in FIG. 5; the Co content then decreases gradually to the nominal Co content. It is believed that the "build up" of cobalt above the nominal content is dictated by the kinetic rate of concurrent processes of carbon diffusion and liquid migration. The results obviously show that the $H_2/CH_4$ ratios in atmospheres have significant effects on the formation of Co gradient. With $(P_{H2})^2/P_{CH4}=150$, the Co content changes from about 4% to 20% within a depth of approximately 350 microns.

Effects of Holding Time on the Formation of Co Gradient

The heat treatment time effect is also an important aspect of the Co gradient formation. In this study, the specimen were heat treated in a fixed atmosphere with $(P_{H2})^2/P_{CH4}=200$ at a fixed temperature of 1300° C. The heat treatment time varied from 15 minutes to 180 minutes.

Figure 6:
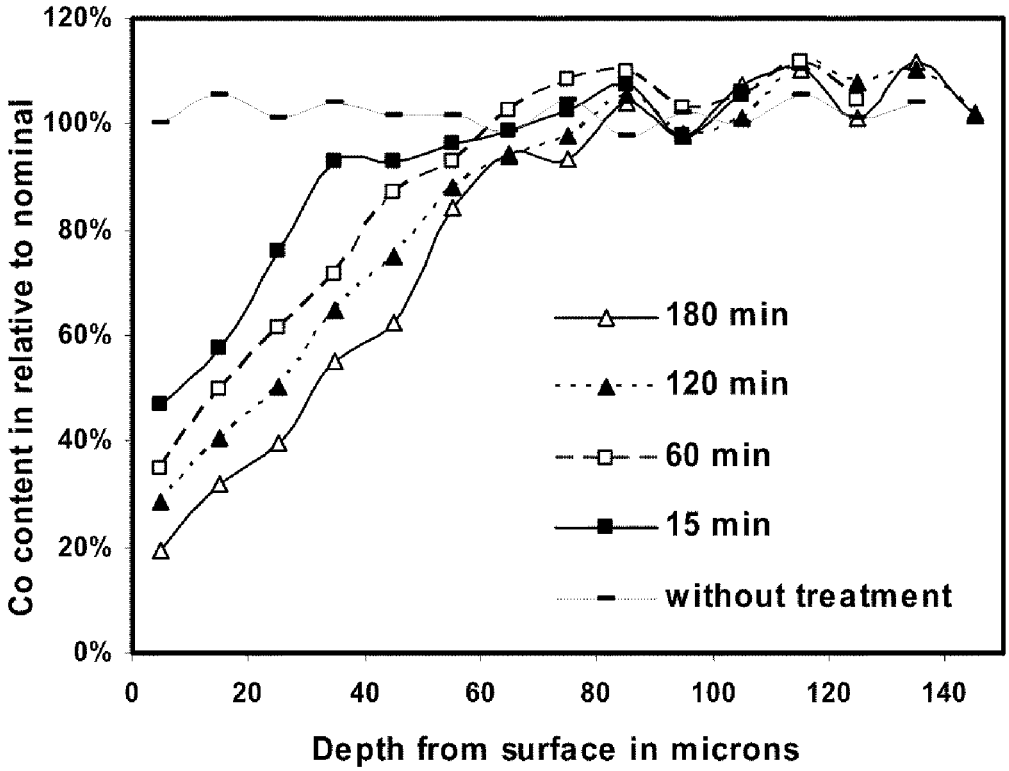
FIG. 6 is a graph showing the cobalt distribution profiles of specimen $10Co_{(C-)}$ which were treated with atmosphere of $(P_{H2})^2/P_{CH4}=200$ at 1300° C. and holding for 15, 60, 120 and 180 minutes.
Figure 7:
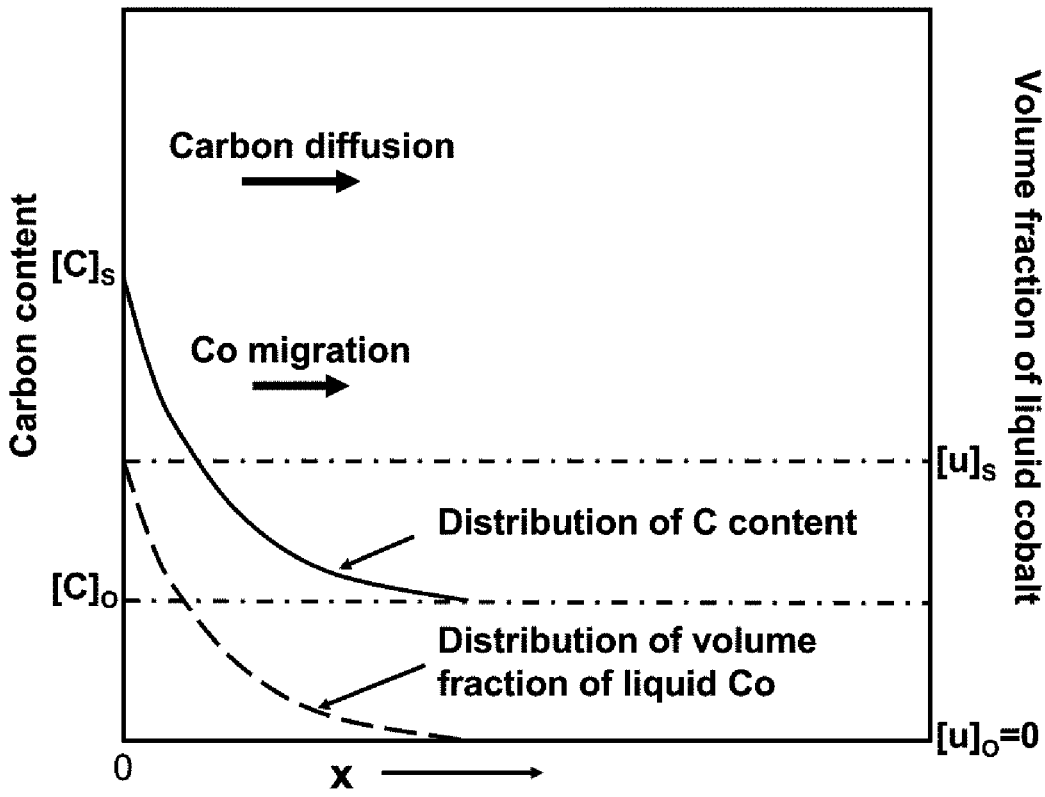
FIG. 7 is a schematic diagram showing the carbon content distribution and the distribution of volume fraction of liquid Co during carburization atmosphere treatment at 1300° C.

A Co gradient is observed in each of the treated specimens as plotted in FIG. 6. Similar to the trends that were described in previous sections, the Co content increases steadily with the depth from the surface inward until Co content approaches the nominal value. Moreover, it was found that both the depth and the amplitude of the Co gradient increase with heat treatment time.

The results outlined herein clearly demonstrated that a Co-gradient at the surface region can be created by carburizing heat treatment of pre-sintered WC—Co. Although not being limited or bound by this theory, it is hypothesized that the formation of the Co gradient are the results of two processes: (1) carbon diffusion due to the gradient of carbon content, and (2) liquid Co migration induced by the gradient of volume fraction of liquid phase as a function of carbon content. The mechanism of the Co gradient formation is discussed herein.

The experimental results in this study clearly demonstrated that a Co-gradient at the surface region can be created through carbonization heat treatment of pre-sintered WC—Co. This appears to be similar to what occurs during the DP carbide fabrication process according to U.S. Pat. Nos. 5,453,241, 5,549,980, and 5,856,626.

In the DP carbide process, η phase is required. It exists before and after carbonization heat treatment during while the η phase reacts with carbon to form WC and cobalt. The reaction releases a lot of liquid Co which causes a transient increase of cobalt content in the local region that migrates and forms a layer with cobalt gradient. As pointed out earlier, η phase is undesired in WC—Co composites because of its brittleness, especially it is detrimental in the final product. In order to mitigate its embrittlement effects to the entire composite, the surface layer must be made sufficiently thick, which in turns limit the effectiveness of the layered structure. The product according to DP carbide process is a hard surface with an harder and more brittle core. The product of this invention, however, is a hard surface with softer and tougher core. In addition, the product of this invention does no require the surface layer to be significantly thick. In fact, to achieve best wear-resistance and toughness combination, the thickness of the surface layer with graded cobalt composition should be less than 10% of the overall thickness or relevant dimension of the components.

Furthermore, the current invention requires that the carbon content of the starting powder mixture to be higher than $C_\eta$ and the composite contains no η phase at any temperature at any time during or after the sintering and heat treatment process.

Furthermore, the current invention requires that the carburizing heat treatment to be carried out within the three-phase temperature range, while the DP carbide technology relies on heat treatment at liquid phase sintering temperature which is in the two-phase temperature range.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A method of preparing a functionally graded cemented tungsten carbide material, the method comprising:

preparing a WC—Co powder;

compacting the powder;

fully sintering the powder to form a completely sintered powder;

heat treating the sintered powder in a furnace having a carburizing atmosphere, wherein the material, after the heat treating step, comprises a surface layer with lower Co content than that of the nominal value of the bulk of the material, wherein the temperature range for the heat treatment step is the range in which solid tungsten carbide WC, liquid cobalt, and solid cobalt coexist.

2. A method as in claim 1, the WC—Co powder has substoichiometric carbon content.

3. A method as in claim 1, the WC—Co powder has substoichiometric carbon content that is higher than the carbon content that would result in the formation of n-phase in the material at any temperature at any time during or after the sintering step or the heat treatment step.

4. A method as in claim 1, wherein the atmosphere is a carburizing gas mixture formed by a methane-hydrogen mixture with the partial pressure ratio of $(P_{H2})^2/P_{CH4}$ ranging from 1000 to 10.

5. A method as in claim 1, wherein the atmosphere is a carburizing gas mixture formed by a methane-hydrogen mixture with the partial pressure ratio of $(P_{H2})^2/P_{CH4}$ is within the range of 600 to 100.

6. A method as in claim 1 wherein the sintered powder is heat treated at a temperature range between 1250 and 1330° C.

7. A method as in claim 1 wherein the sintering and heat treating are conducted in one furnace run without removing the material from the furnace after the sintering step.

8. A method as in claim 1 wherein the sintering and heat treating are conducted in two separate furnaces such that there are two separate thermal cycles.

9. A method as in claim 1 wherein said WC—Co powder contains one or combinations of the following elements and/or of their carbides: titanium, tantalum, chromium, molybdenum, niobium, and vanadium.

10. A method as in claim 1 wherein said WC—Co powder contains nickel (Ni) and/or iron (Fe), which substitute cobalt (Co) in part.

* * * * *